US005135315A

United States Patent [19]

Kitahara et al.

[11] Patent Number: 5,135,315

[45] Date of Patent: Aug. 4, 1992

[54] TRANSFER PRINTER WITH RIBBON TRANSMISSION DRIVE GEAR

[75] Inventors: Satoshi Kitahara, Mishima; Seiichirou Yamamoto, Fuji, both of Japan

[73] Assignee: Tokyo Electric Co., Ltd., Tokyo, Japan

[21] Appl. No.: 728,240

[22] Filed: Jul. 10, 1991

[30] Foreign Application Priority Data

Jul. 13, 1990 [JP] Japan ..... 2-184033

[51] Int. Cl.[5] ..... B41J 11/20

[52] U.S. Cl. ..... 400/56; 400/120; 400/223; 400/664

[58] Field of Search ..... 400/56, 58, 120, 223, 400/663, 664, 636

[56] References Cited

U.S. PATENT DOCUMENTS

| | | | |
|---|---|---|---|
| 4,575,267 | 3/1986 | Brull | 400/56 |
| 4,886,384 | 12/1989 | Harry | 400/223 |
| 5,000,591 | 3/1991 | Burgess | 400/56 |
| 5,061,095 | 10/1991 | Asai et al. | 400/636 |
| 5,062,722 | 11/1991 | Shiozaki | 400/120 |
| 5,064,300 | 11/1991 | Kashiwabe | 400/56 |

FOREIGN PATENT DOCUMENTS

| | | | |
|---|---|---|---|
| 0006491 | 1/1985 | Japan | 400/223 |

*Primary Examiner*—Eugene H. Eickholt

*Attorney, Agent, or Firm*—Frishauf, Holtz, Goodman & Woodward

[57] ABSTRACT

A transfer printer includes a platen drive mechanism for rotating a platen roller facing a print head, and a paper feed mechanism for feeding a paper sheet passing between the platen roller and the head. A ribbon supply device is driven through a transmission mechanism by the drive power of the feed mechanism. The transmission mechanism has a roller holder supporting a transmission gear and arranged to be movable between a transmission position wherein the transmission gear engages an interlocking gear of the feed mechanism and an input gear of the ribbon supply device and a release position wherein the transmission gear is disengaged from the input gear so as to interrupt the power transmission. The roller holder is urged by a spring toward the transmission position, and restricted an excessive movement to the transmission position so that the transmission gear is in mesh with the input gear with a suitable backlash.

11 Claims, 3 Drawing Sheets

TRANSFER PRINTER WITH RIBBON TRANSMISSION DRIVE GEAR

BACKGROUND OF THE INVENTION

1. Field of the Invention

The present invention relates to a transfer printer for printing information by feeding a paper sheet into between a stationary print head and a platen roller along with a transfer ribbon, and transferring ink from the transfer ribbon onto the paper sheet by means of the print head.

2. Description of the Related Art

In a known transfer printer such as a label printer, feeding of a paper sheet by means of a paper feed roller is performed in interlock with rotation of a platen roller and transfer of a transfer ribbon. In practice, while the paper sheet driven by the feed roller runs between the print head and the rotating platen roller, the transfer ribbon is passed between the print head and the platen roller by rotating of the platen roller. In other words, the paper sheet and the transfer ribbon pass together in overlay relationship between the print head and the platen roller.

Since the paper sheet and the transfer ribbon are fed together at once, if information is printed on part of a label posted on the paper sheet, or if the label has a non-printing section, that portion of the transfer ribbon which corresponds to the non-printing section of the label is wastefully transferred.

For preventing wasteful use of the transfer ribbon, the printer is generally provided with a transmission mechanism arranged between a platen drive mechanism for rotating the platen roller and a ribbon drive mechanism for supplying the transfer ribbon. The transmission mechanism transmits drive power from the platen drive mechanism to the ribbon drive mechanism and interrupts the power transmission. When a non-printing section of each label comes, the transmission of the drive power is interrupted to stop the running of the transfer ribbon, thereby avoiding wasteful use of the ribbon.

The transmission mechanism includes a transmission gear supported by a pivotable gear holder. In general, the transmission gear remains in mesh with an interlocking gear arranged for rotating in interlock with the action of the platen drive mechanism and also, is capable of engaging an input gear of the ribbon drive mechanism for feeding the transfer ribbon. The holder is urged by a spring for rendering the transmission gear in mesh with the input gear.

By rocking the gear holder against the spring force of the spring, the transmission gear can be disengaged from the input gear while being in mesh with the interlocking gear. The transmission gear meshing with the interacting gear. Thus, the transfer ribbon can be transferred in interlock with the feeding of the paper sheet by the drive power transmitted through the co-movement of the two gears and is stopped by disengaging the gears from each other.

However, the engagement between the transmission gear and the input gear is determined by the urging force of the spring and thus, deeply intersected with no backlash. Also, since the gear holder is rocked, the pivotal point of the gear holder is off the line extending between the centers of the transmission and input gears.

Accordingly, when the transmission gear is engaged with or disengaged from the input gear by the pivotal action of the gear holder while the platen drive mechanism is operated or the transmission gear is rotated, its teeth tend to bite the teeth of the input gear. As the result, loads exerted on the two gears become large and the operational life of the gears will be decreased.

In the conventional printer, for prevention of the foregoing drawback, the platen drive mechanism is stopped when the drive mechanism for feeding a transfer ribbon is connected and disconnected to the power train. More specifically, the transmission gear is engaged with or disengaged from the input gear while it stops rotating. This allows loads exerted on both the gears during the action of engagement and disengagement to be released by free rotating movements of the gears. However, the running of a paper sheet has to be interrupted when the feeding of the transfer ribbon starts or stops, so that the action of ribbon saving will take a considerable period of time.

SUMMARY OF THE INVENTION

It is an object of the present invention to provide a transfer printer in which the ribbon saving action is prompt to complete and the operational life of gears for feeding a transfer ribbon is prolonged.

In order to achieve the above object, a transfer printer according to the present invention includes power transmitting means for transmitting power from platen driving means to ribbon driving means to drive the ribbon driving means. The power driving means comprises a transmission gear meshed constantly with an interlocking gear of the platen driving means, means for supporting the transmission gear so that the transmission gear is movable between a transmission position where it comes into engagement with both the interlocking gear and an input gear of the ribbon driving means and a release position where it comes in disengagement from the input gear, means for urging the supporting means in a direction to hold the transmission gear in the transmission position, and releasing means for moving the transmission gear to the release position. The movement of the transmission gear toward the transmission position is restricted by a restricting means so that the transmission gear comes in mesh with the input gear at a given depth of engagement.

In operation of the printer having the foregoing arrangement, the releasing means is actuated when the non-printing section of each recording medium comes up to a printing portion between a print head and a platen roller. Then, the supporting means of the transmitting means is moved against the urging force of the urging means, thus disengaging the transmission gear from the input gear of the ribbon driving means. Thus, the transmission of power from the platen driving means to the ribbon driving means is interrupted and the ribbon driving means stops actuating. As a result, wasteful feeding of the transfer ribbon will thus be prevented for ribbon saving.

When the non-printing section of the recording medium has passed away the printing portion, the action of the releasing means is completed and the ribbon saving action ends. At the same time, the supporting means is moved by the urging means, actuating the transmission gear to engaged with the input gear. As the result, the power from the platen driving means is transmitted to the ribbon driving means, so that the transfer ribbon is fed along with the recording medium.

Simultaneously, the movement of the transmission gear is restricted by the restricting means regardless of the urging force of the urging means being exerted on the supporting means. Hence, the transmission gear can mesh with the input gear with proper backlash. This allows both the transmission gear and the input gear to be driven by a comparatively less power. In other words, the power requirement for feeding of the transfer ribbon in synchronism with the running of the recording medium will be minimized. Also, the tooth biting assault of the transmission gear on the input gear during the action of engagement and disengagement will be reduced by the effect of backlash. According to the present invention, the engagement and disengagement between the transmission gear and the input gear can be executed without interrupting the running of a paper sheet to be printed and the ribbon saving action will be conducted within a short time.

Additional objects and advantages of the invention will be set forth in the description which follows, and in part will be obvious from the description, or may be learned by practice of the invention. The objects and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 4 illustrate a label printer according to an embodiment of the present invention, in which:

FIG. 1 is a side view schematically showing a part of the label printer;

FIG. 2 is a schematic view showing a drive train of the label printer;

FIG. 3 is a cross sectional view showing a platen releasing mechanism and a paper feed mechanism; and FIG. 4 is a side view showing a transmission mechanism.

DETAILED DESCRIPTION OF THE PREFERRED EMBODIMENTS

A preferred embodiment of the present invention will be described in the form of a label printer referring to the accompanying drawings.

Figure 1:
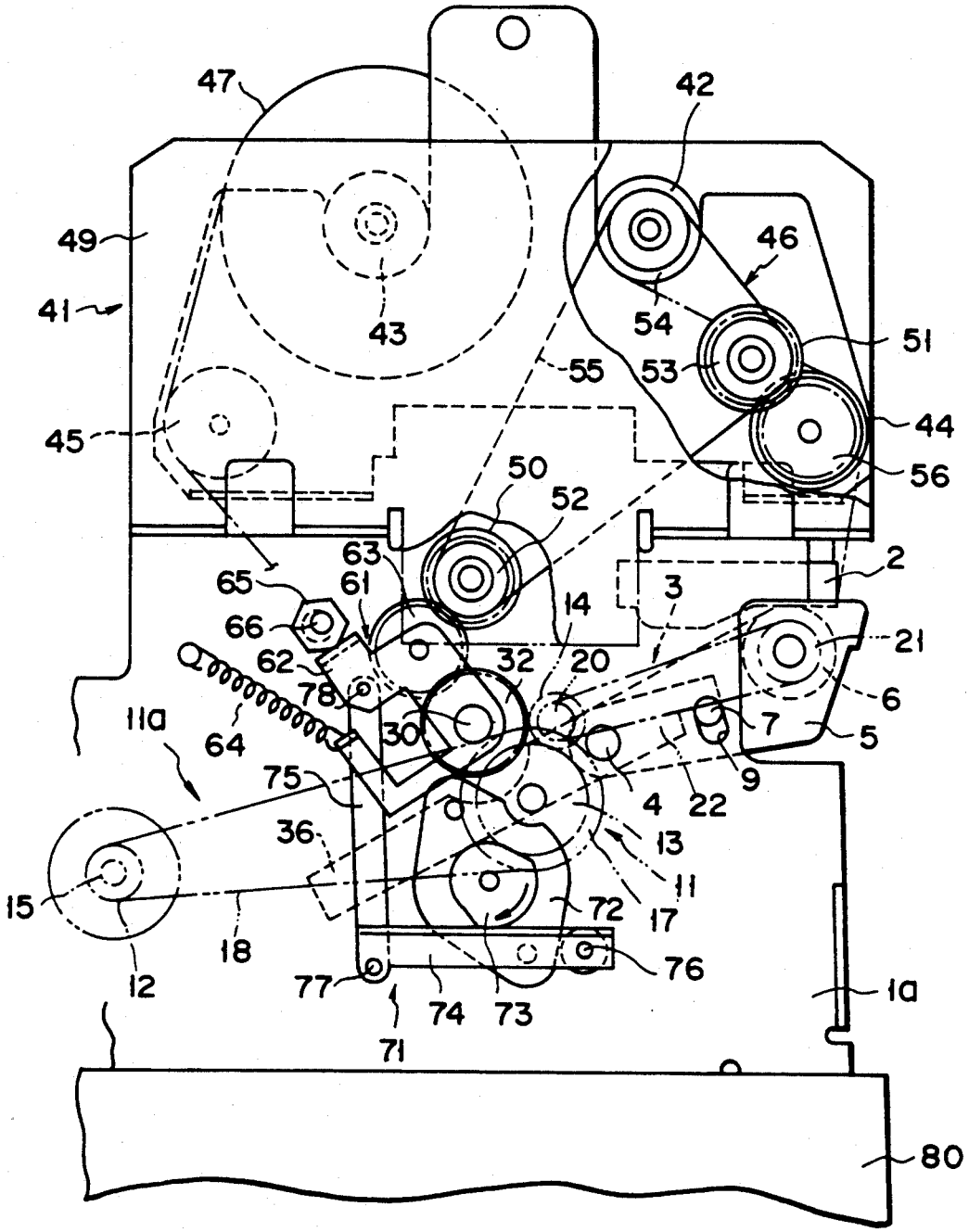
Figure 2:
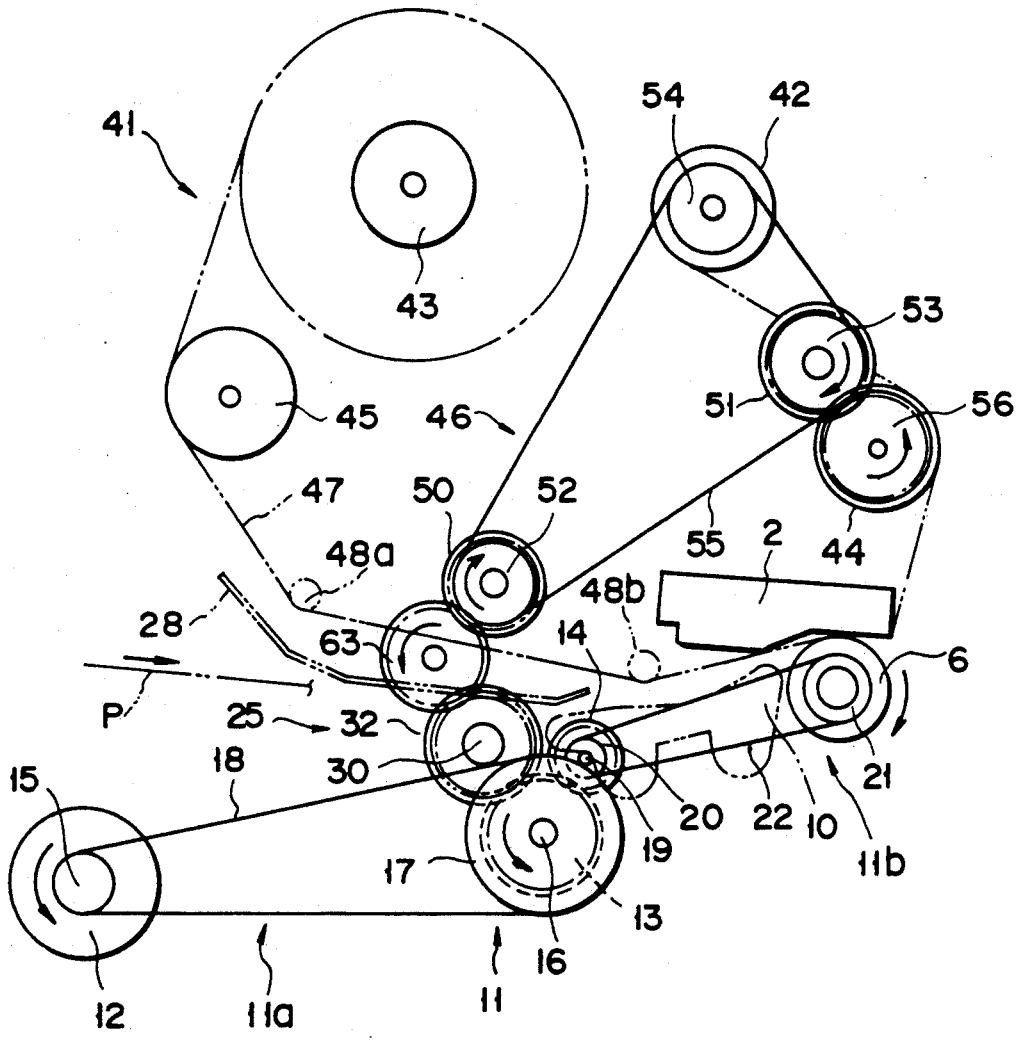
Figure 3:
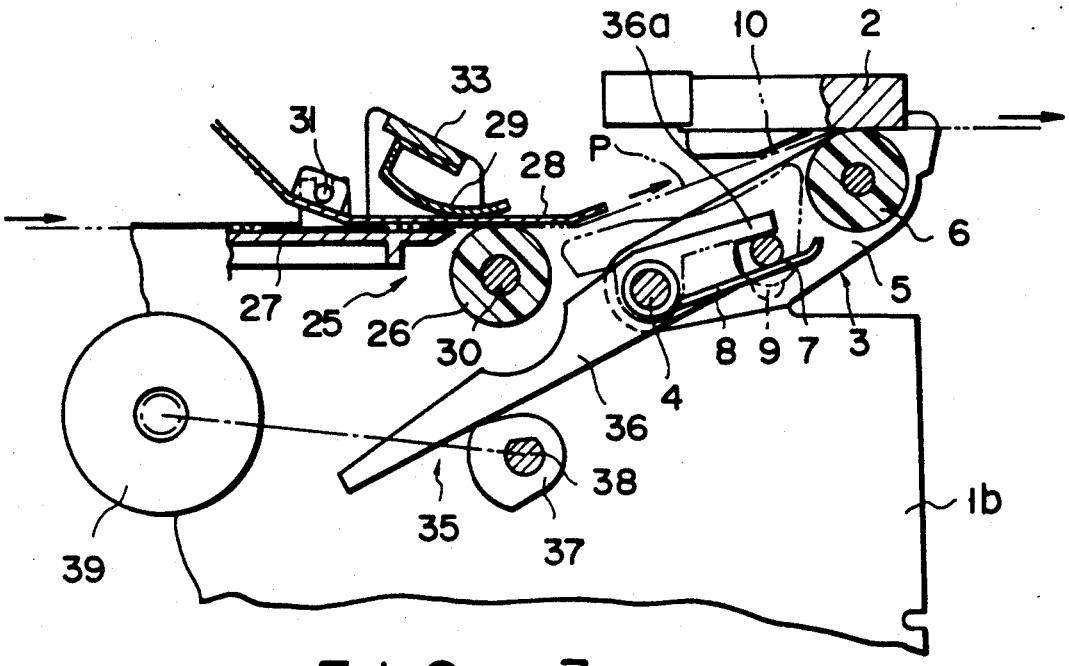

As shown in FIGS. 1 to 3, the label printer has a base 80 and a pair of left and right frame side plates 1*a* and 1*b* mounted upright on the base 80 so as to face each other. The side plates 1*a* and 1*b* extend vertically and constitute part of a body frame which is covered with a detachable casing (not shown). A print head 2 and a platen unit 3 disposed beneath the head 2 are arranged between the two side plates 1*a* and 1*b*. The print head 2 is a line thermal head which has a length equal to the axial length of a platen roller, described later, and is attached to the side plates 1*a* and 1*b* in stationary arrangement.

The platen unit 3 comprises a stationary shaft 4, a pair of left and right platen frames 5 of planar shape, a platen roller 6, a pressure shaft 7, and a torsion coil springs 8. In more detail, the stationary shaft 4 is transversely stretched between the two side plates 1*a* and 1*b* and fitted at both ends thereof with the two platen frames 5 arranged for rotation about the stationary shaft 4. The platen roller 6 is transversely mounted between the respective front ends of the platen frames 5 for rotating motion and extends in parallel to the print head 2. The pressure shaft 7 is transversely mounted between the respective intermediate portions of the platen frames 5. Each end of the pressure shaft 7 penetrates its corresponding platen frame 5 and is inserted into a slit 9 formed in its corresponding side plate. The coil spring 8 is wound on the stationary shaft 4 with one end fixedly coupled to the same and with the other end pressed against the shaft 4 from under the same. In the FIGS. 2 and 3, reference numeral 10 represents a paper guide mounted on the platen unit 3, for guiding a paper sheet P into between the print head 2 and the platen roller 3. The paper sheet P used is an elongated continuous base paper on which a plurality of labels are pasted at regular intervals.

The platen unit 3 is urged by the urging force of the torsion coil spring 8 in the counter-clockwise direction about the stationary shaft 4 as shown in FIGS. 1 or 3. Accordingly, the platen roller 6 is pressed against the lower surface of the print head 3.

The platen roller 6 is adapt to be rotated by a platen drive mechanism 11 shown in FIGS. 1 and 2. The drive mechanism 11 comprises a first pulse motor 12 mounted on the side plate 1*a*, a first belt drive system 11*a* actuated by the pulse motor 12, a pair of large and small gears 13 and 14 meshing with each other, and a second belt drive system 11*b*.

The first belt drive system 11*a* includes a drive-side toothed pulley 15 fixedly mounted on the spindle of the pulse motor 12, a driven-side toothed pulley 17 formed integral with the large gear 13 and rotatably mounted on a shaft 16 with the large gear 13, and a timing belt 18 stretched between the two pulleys 15 and 17. Also, the second belt system 11*b* includes a drive-side toothed pulley 20 formed integral with the small gear 14 and rotatably mounted on a shaft 19 with the small gear 14, a driven-side toothed pulley 21 coupled to one end of the platen roller 6, and a timing belt 22 stretched between the two pulleys 20 and 21. The shafts 16 and 19 are fixedly attached to the outer surface of the frame side plate 1*a*.

When the pulse motor 12 of the platen drive mechanism 11 rotates in the counter-clockwise direction as shown in FIG. 2, the pulleys 15 and 17, belt 18, and large gear 13 of the first belt drive system 11*a* are all rotated in the same direction. Simultaneously, the small gear 14 meshing with the large gear 13 starts rotating in the opposite or clockwise direction and thus, the pulleys 20 and 21 and belt 22 of the second belt drive system 11*b* are rotated in the same clockwise direction. Hence, the platen roller 6 is driven for clockwise rotation. For feeding back the paper sheet, the pulse motor 12 is activated for rotating in the reverse direction.

A paper feed mechanism 25 is arranged in the rear of the platen unit 3 and between the side plates 1*a* and 1*b*. As shown in FIGS. 1 and 3, the feed mechanism 25 comprises a paper feed roller 26, a lower paper guide 27, an upper paper guide 28, a backup leaf spring 29, and a interlocking gear 32.

The feed roller 26 is located in the rear of the paper guide 10 and extends approximately in parallel to the platen roller 6. A roller shaft 30 of the feed roller 26 is rotatably supported at both ends by the frame side plates 1*a* and 1*b*, respectively. The roller shaft 30 is also coupled at one end with the interlocking gear 32 which is in mesh with the large gear 13 of the platen drive mechanism 11. The lower paper guide 27 is arranged in the rear of the feed roller 26. The upper paper guide 28 is disposed between the feed roller 26 and the lower web guide 27 and its front end is located above the rear end of the paper guide 10. Also, the upper paper guide 28 is supported by the side plates 1*a* and 1*b* for rotating about a pivot 31 and urged downward by the leaf spring 29 to press against the feed roller 26. Reference numeral 33 in FIG. 3 represents a traverse plate stretched between the side plates 1*a* and 1*b* and having the leaf spring 29 fixedly mounted on the inner side thereof.

The feed mechanism 25 is adapted for feeding the paper sheet P, which has been introduced between the feed roller 26 and the upper paper guide 28, into between the print head 2 and the platen roller 6 by the rotation of the feed roller 26. The feed roller 6 is driven via the interacting gear 32 by the large gear 13.

As shown in FIG. 3, the printer further comprises a platen releasing mechanism 35 for releasing the platen roller 6 form the print head 2 during the action of transfer ribbon saving which will be described in more detail later. The releasing mechanism 35 includes a release lever 36, a cam shaft 38 carrying a cam 37 fixed thereto, and a second pulse motor 39 for rotating the cam shaft 38.

The release lever 36 is fitted at its intermediate portion on the stationary shaft 4 for pivotal movement. The front end 36*a* of the release lever 36 is engaged with the the pressure shaft 7 from over the same. The cam shaft 38 is transversely mounted between the side plates 1*a* and 1*b* for rotating so that the cam 37 on the cam shaft 38 comes in engagement with the rear end bottom of the release lever 36. The second pulse motor 39 is fixed to the side plate 1*b*, which faces the side plate 1*a* carrying the platen drive mechanism 11, and rotates the cam shaft 38 through a gear train (not shown).

When the second pulse motor 39 is activated, the cam shaft 38 rotates in the clockwise direction as shown in FIG. 3. Thus, the cam 37 rotates the release lever 36 about the stationary shaft 4 in the clockwise direction. Accordingly, the release lever 36 pushes down the pressure shaft 7 of the platen unit 3 against the urging force of the torsion coil spring 8. In accordance with the rotation of the platen frames 5 about the stationary shaft 4, the platen roller 6 is moved downward and released from the print head 2. The reverse rotation of the second pulse motor 39 allows the platen roller 6 to be lifted up by the urging force of the torsion coil spring 8. Thus, the platen releasing mechanism 35 returns to its original position shown in FIG. 3.

A ribbon supply device 41 is provided above the print head 2 as shown in FIGS. 1 and 2. The ribbon supply device 41 comprises a take-up shaft 42, a supply shaft 43, a pair of front and rear guide shafts 44 and 45, and a ribbon drive mechanism 46. The take-up and supply shafts 42 and 43 are detachably mounted on the main body of the device 41. In operation, a transfer ribbon 47 fed from the supply shaft 43 passes between the print head 2 and the platen roller 6 during running from the rear guide shaft 45 to the front guide shaft 44 and then, is rewound on the take-up shaft 42. In FIG. 2, reference numerals 48*a* and 48*b* represent guide shafts of the ribbon supply device 41, arranged between the front 44 and rear guide shaft 45.

The ribbon drive mechanism 46 includes an input gear 50 rotatably mounted on the inner surface of a frame 49 of the ribbon supply device 41, a drive gear 51 mounted on the frame 49 close to the front guide shaft 44, and a belt drive system. The belt drive system of the ribbon drive mechanism 46 comprises a drive-side toothed pulley 52 formed integral with the input gear 50, a driven-side toothed pulley 53 formed integral with the drive gear 51, another driven-side toothed pulley 54 coupled to one end of the take-up shaft 42, and a timing belt 55 stretched between the three toothed pulleys 52, 53, and 54. The drive gear 51 is meshed with a driven gear 56 mounted on one end of the front guide shaft 44.

When the rotational force for rotating the input gear 50 in the clockwise direction is transmitted thereto as shown in FIGS. 1 and 2, the ribbon drive mechanism 46 actuates the take-up shaft 42 to rotate in the same direction. Simultaneously, the front guide roller 44 is driven through the drive gear 51 and the driven gear 56 for rotation in the counter-clockwise direction. Accordingly, the transfer ribbon 47 passed between the printing head 2 and the platen roller 6 will be rewound onto the take-up shaft 42. The running speed of the ribbon 47 is identical with the feeding speed of the paper sheet P.

Figure 4:
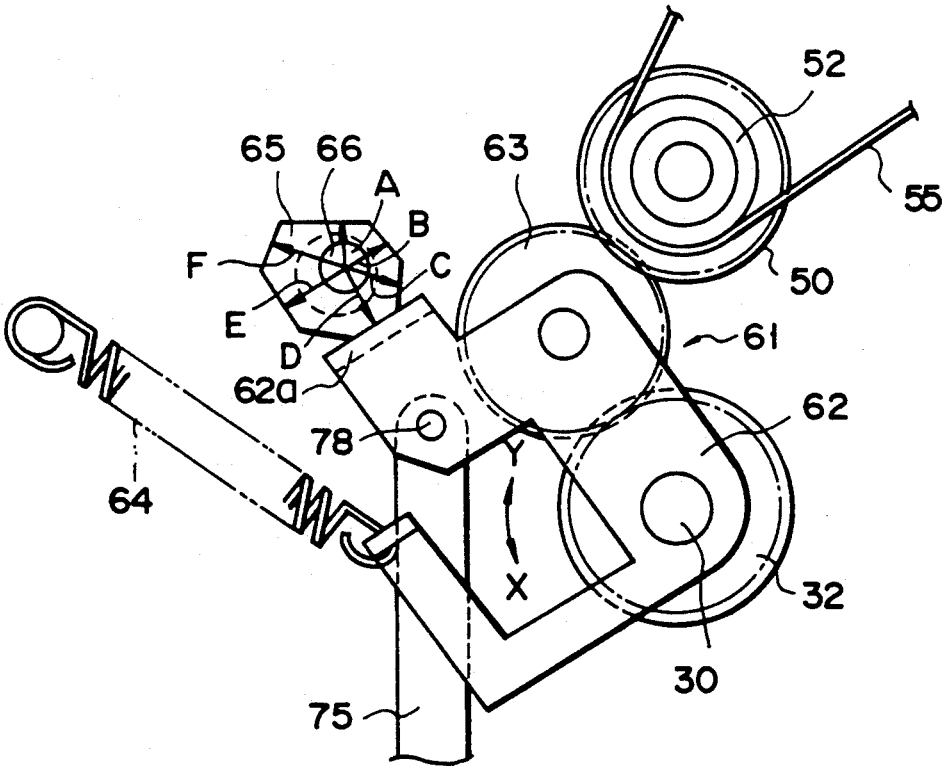

The ribbon drive mechanism 46 is actuated in interlock with the operation of the platen drive mechanism 11 and the paper feed mechanism 25 through a transmission mechanism 61. The transmission mechanism 61 has a gear holder 62 rockably mounted on the roller shaft 30 of the feed roller 32, and a transmission gear 63 rotatably supported by the holder 62, as best shown in FIG. 4. The transmission gear 63 is arranged in mesh with the interacting gear 32 and capable of engaging with and disengaging from the input gear 50 in accordance with the rocking action of the gear holder 62.

A tension coil spring 64 as urging means is stretched between the gear holder 62 and the frame side plate 1*a*. Thus, the gear holder 62 is always urged by the tension spring 64 in the direction to engage the transmission gear 63 with the input gear 50.

The gear holder has a contact portion arranged opposite to the roller shaft 30 with respect to the transmission gear 63. A stopper 65 is attached by a screw 66 to the frame side plate 1*a* and located adjacent to the contact portion 62*a* of the gear holder 62. The stopper 65 is adapted for determining the depth of engagement between the transmission gear 63 and the input gear 50 at a suitable degree value regardless of the urging force of the spring 64. More specifically, the stopper 65 positions the gear holder 62 so that the transmission gear 63 can mesh with the input gear 50 at a proper rate of backlash, thereby regulating the depth of engagement between the gears.

The stopper 65 is formed in a hexagonal shape, for example, and the screw 66 is inserted through a hole bored in the stopper, which is eccentric to the center of the stopper. Therefore, the distances A to F from the center of the screw 66 to the sides or positioning surfaces of the stopper are different from each other. The intermeshing between the two gears 50 and 63 can thus be adjusted by tightening the screw 66 to position the stopper 65 so that selected one of the six positioning surfaces of the stopper 65 is adapted to abut the contact portion 62*a* of the gear holder 62. This adjustment is conducted with a clearance gage measuring the clearance between the two gears 50 and 63, for the purpose of correction of accumulated dimensional errors derived from each component and resulting from improper installation.

With the use of the stopper 65 of a polygonal shape, the adjusted position of the stopper can be maintained unchanged even if the screw 66 becomes loosened a bit.

If loosening of the screw 65 is not expected, the stopper 65 may be of a circular shape so that the intermeshing between the two gears 50 and 63 will be adjusted by stepless manner. Also, the stopper 65 may be of sliding type so that the contact position between the stopper and the contact portion 62*a* can be adjusted.

The transmission mechanism 61 is coupled to a disengagement mechanism 71 for rocking the gear holder 62 against the urging force of the spring 64 during the ribbon saving action. As shown in FIG. 1, the disengagement mechanism 71 comprises a third pulse motor 72 mounted on the side plate 1*a*, a cam 73 arranged to be rotated by the motor 72, and first and second links 74 and 75 adapted for being actuated by the cam 73. The first link 74 extending horizontally is coupled at one end by a pivot pin 76 to the side frame plate 1*a* for pivotal movement and at the other end by another pivot pin 77 to the lower end of the second link 75. The upper end of the second link 75 is pivotably connected through a pivot pin 78 to the gear holder 62.

As the cam 73 is rotated in the clockwise direction in FIG. 1 by the third pulse motor 72 during the ribbon saving action, it actuates the first link 74 to lower the second link 75. Then, the gear holder 62 is rotated about the roller shaft 30 in the counter-clockwise direction against the urging force of the spring 64. As the result, the transmission gear 63 is disengaged from the input gear 50. When the cam 73 is rotated in the opposite direction by the reverse action of the third pulse motor 72, the gear holder 62 is turned in the clockwise direction by the spring 64 until it abuts against the stopper 65. Thus, the transmission gear 63 is again in mesh with the input gear 50.

In the printing operation of the label printer having the foregoing arrangement, the feeding of a paper sheet is carried out by the rotation of the platen roller 6 of the platen drive mechanism 11 and the rotation of the sheet feed roller actuated in synchronism with the platen roller rotation Also, during the paper feeding, the transmission gear 63 of the transmission mechanism 61, which is always in mesh with the interlocking gear 32 and rotated thereby, remains in mesh with the input gear 50 of the ribbon drive mechanism 46. Hence, the transfer ribbon 47 is rewound onto the take-up shaft 42 by the action of the drive mechanism 46 and transferred together with the paper paper at the same speed between the print head 2 and the platen roller 6.

If a label on the base paper has a non-printing section, the ribbon saving action is triggered. More specifically, the cam 73 is rotated in the forward direction by the third pulse motor 72 and thus, the gear holder 62 is rotated in the direction of arrow X in FIG. 4 against the urging force of the spring 64. The transmission gear 63 is then disengaged from the input ear 50. As the result, no power is transmitted to the ribbon supply device 41 which thus stops the feeding of the transfer ribbon 47. Also, upon or just after the start of the third pulse motor 72, the second pulse motor 37 is activated for rotating the cam 37 in the counter-clockwise direction in FIG. 3. The platen roller 6 is then moved downward and separated from the print head 2. This prevents the transfer ribbon 47 from being pulled by the rotation of the platen roller 6 and allows the paper sheet P to be transferred between the print head 2 and the platen roller 6 which are now spaced from each other.

In this manner, when the non printing section of the label comes to between the print head 2 and the platen roller 6, the feeding of the transfer ribbon 47 is stopped and thus, wasteful use of the ribbon will be avoided.

After the completion of the ribbon saving action, both the second and third pulse motors 39 and 72 are rotated in the reverse direction at the timing of action similar to the start of the ribbon saving action. The gear holder 62 thus is rotated by the spring 64 in the direction of arrow Y in FIG. 4 before coming into contact with the stopper 65. As the result, the transmission gear 63 moves into engagement with the input gear 50, thereby allowing the transfer ribbon 47 to run together with the paper sheet P at the same speed.

The gear holder 62 remains urged by the spring 64 for rendering the transmission 63 in mesh with the input gear 50. However, since the stopping position of the gear holder 62 is controlled by the stopper 65, the meshing of the transmission gear 63 with the input gear 50 is optimized with no excessive intersection but at a proper rate of backlash. Accordingly, the two gears 50 and 63 can be driven by a relatively less force and the driving force needed for feeding the transfer ribbon in synchronism with the running of the paper sheet will be minimized. Also, the two gears 50 and 63 are meshed with each other at appropriate backlash and unwanted biting effects resulting from the physical contact between the teeth of the transmission gear 63 and the teeth of the input gear 50 can be lessened. Hence, undesired loads developed during the engagement and disengagement between the two gears 50 and 63 will be minimized thus decreasing damage to the teeth. The transmission gear 63 can be engaged with and disengaged from the input gear 50 while the paper sheet is running. This ensures no interruption of the running of the paper sheet while the ribbon saving action is executed. Consequently, the duration of the ribbon saving action will be shortened.

It should be understood that the present invention is not limited to the foregoing embodiment and a various changes and modifications may be applied without departing from the scope of the present invention. For example, the stopper 65 may be arranged to restrict the movement of the first or second link rather than the gear holder 62 so as to define the stopping position of the transmission gear 63.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A transfer printer comprising:

a print head;

a platen roller arranged opposite to the print head;

platen drive means for rotating the platen roller;

means for feeding a recording medium passing between the print head and the platen roller in interlock with the operation of the platen drive means, said feeding means having an interlocking gear rotatable in interlock with the operation of the platen drive means;

ribbon supply means having ribbon drive means with an input gear, for feeding a transfer ribbon between the print head and the platen roller; and means for transmitting drive power from the platen drive means to the ribbon drive means so as to drive the ribbon drive means, said transmitting means including a transmission gear meshed constantly with the interlocking gear, means for supporting the transmission gear so that the transmission gear is movable between a transmission position where the transmission gear engages both the interlocking gear and the input gear and a release position where the transmission gear disengages from the input gear, means for urging the supporting means to hold the transmission gear in the transmission position, release means for moving the transmission gear to the release position, and means for restricting the movement of the transmission gear toward the transmission position so that the transmission gear is in mesh with the input gear at a predetermined depth of engagement.

2. A printer according to claim 1, wherein said restricting means has a stopper which comes into contact with the supporting means when the transmission gear is moved to the transmission position.

3. A printer according to claim 2, wherein said stopper includes means for adjusting a contact position between the stopper and the supporting means so that the depth of engagement between the transmission gear and the input gear varies depending on the contact position.

4. A printer according to claim 3, wherein said adjusting means includes a plurality of contact portion formed on the stopper and adapted to contact the supporting means, and fixing means for supporting the stopper to be rotatable about a rotational center and fixing the stopper in a desired rotated position wherein one of the contact portion is capable of contacting the supporting means, the contact portions being spaced from the rotational center by distances different from each other.

5. A printer according to claim 2, wherein said feeding means includes a feed roller arranged substantially in parallel to the platen roller, for feeding the recording medium, the feed roller having a roller shaft, said supporting means includes a gear holder rotatably mounted on the roller shaft, and said transmission gear rotatably supported by the gear holder while being in mesh with the interlocking gear.

6. A printer according to claim 5, wherein said gear holder has a contact portion for contacting the stopper in said transmission position, the contact portion being located opposite to the roller shaft with respect to the transmission gear.

7. A printer according to claim 1, wherein said releasing means includes an operating member connected to the supporting means, a cam engaging the operating member, and driving means for rotating the cam to move the supporting means through the operating member.

8. A printer according to claim 1, wherein said platen roller is arranged for movement to come into contact with and depart from the print head, and which further comprises a platen releasing means for moving the platen roller away from the print head.

9. A transfer printer comprising:

a print head;

a platen arranged opposite to the print head;

feeding means having an interlocking gear, for feeding a recording medium passing between the print head and the platen;

ribbon supply means having ribbon drive means with an input gear, for feeding a transfer ribbon between the print head and the platen; and means for transmitting drive power from the feeding means to the ribbon drive means so as to drive the ribbon drive means, said transmitting means including a transmission gear meshed constantly with the interlocking gear, means for supporting the transmission gear so that the transmission gear is movable between a transmission position where the transmission gear engages both the interlocking gear and the input gear and a release position where the transmission gear disengages from the input gear, means for urging the supporting means to hold the transmission gear in the transmission position, release means for moving the transmission gear to the release position, and means for restricting the movement of the transmission gear toward the transmission position so that the transmission gear is in mesh with the input gear at a predetermined depth of engagement.

10. A printer according to claim 9, wherein said restricting means has a stopper which comes into contact with the supporting means when the transmission gear is moved to the transmission position.

11. A printer according to claim 10, wherein said stopper includes means for adjusting a contact position between the stopper and the supporting means so that the depth of engagement between the transmission gear and the input gear varies depending on the contact position.

* * * * *